US007669574B2

(12) United States Patent
Nagahashi et al.

(10) Patent No.: US 7,669,574 B2
(45) Date of Patent: Mar. 2, 2010

(54) ACCESSORIES ARRANGEMENT STRUCTURE OF INTERNAL COMBUSTION ENGINE FOR MOTORCYCLE

(75) Inventors: Yoshiki Nagahashi, Saitama (JP); Toru Oshita, Saitama (JP); Masaki Yoneyama, Saitama (JP); Kohji Minami, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 191 days.

(21) Appl. No.: 11/710,553

(22) Filed: Feb. 26, 2007

(65) Prior Publication Data

US 2007/0204828 A1 Sep. 6, 2007

(30) Foreign Application Priority Data

Feb. 28, 2006 (JP) ..... 2006-052763

(51) Int. Cl.

| | |
|---|---|
| ***F02B 75/06*** | (2006.01) |
| ***F01M 11/03*** | (2006.01) |
| ***F01M 5/00*** | (2006.01) |
| ***F01M 1/02*** | (2006.01) |
| ***F01M 9/10*** | (2006.01) |
| ***F01M 11/02*** | (2006.01) |

(52) U.S. Cl. ..... 123/192.2; 123/196 R; 123/196 A; 123/196 AB

(58) Field of Classification Search ..... 123/192.2, 123/196 R, 41.35, 192.1, 196 A, 196 AB
See application file for complete search history.

(56) References Cited

U.S. PATENT DOCUMENTS

| | | | | |
|---|---|---|---|---|
| 4,834,219 | A | 5/1989 | Inagaki et al. | |
| 4,836,156 | A | 6/1989 | Inagaki et al. | |
| 4,848,170 | A | 7/1989 | Inagaki et al. | |
| 5,533,472 | A * | 7/1996 | Sands et al. | 123/41.35 |
| 5,896,656 | A * | 4/1999 | Laws | 29/888.011 |
| 7,017,545 | B2 * | 3/2006 | Sato et al. | 123/192.2 |
| 7,104,239 | B2 * | 9/2006 | Kawakubo et al. | 123/192.2 |
| 7,347,169 | B2 * | 3/2008 | Nagahashi et al. | 123/41.35 |
| 2003/0041815 | A1 * | 3/2003 | Kawakubo et al. | 123/41.35 |
| 2005/0016488 | A1 * | 1/2005 | Kawakubo et al. | 123/192.2 |

(Continued)

FOREIGN PATENT DOCUMENTS

| | | | |
|---|---|---|---|
| DE | 3739243 | A1 | 7/1988 |

(Continued)

*Primary Examiner*—Stephen K Cronin
*Assistant Examiner*—Sizo B Vilakazi
(74) *Attorney, Agent, or Firm*—Birch, Stewart, Kolasch & Birch, LLP

(57) ABSTRACT

An accessories arrangement structure for an internal combustion engine for securing a banking angle, increasing a degree of the freedom of the layout, concentrating heavy accessories and an overhanging part of the internal combustion engine, enhancing the maneuverability of the vehicle and reducing the size of the engine. An accessories arrangement structure of an internal combustion engine for a motorcycle includes an oil cooler and an oil filter that are attached together with a balancer in a lower part wherein the front of a crankcase that journals a crankshaft directed in a vehicular width direction, in which the oil cooler and the oil filter are attached to the front in a vehicular traveling direction of the crankcase project with a balancer, the oil cooler and the oil filter being adjacent in a front view of the vehicle and arranged abreast in parallel with a crankshaft.

18 Claims, 9 Drawing Sheets

U.S. PATENT DOCUMENTS

| | | | | |
|---|---|---|---|---|
| 2005/0061284 | A1* | 3/2005 | Sato et al. | 123/192.2 |
| 2007/0012278 | A1* | 1/2007 | Takeuchi | 123/192.2 |
| 2008/0087255 | A1* | 4/2008 | Aoyama et al. | 123/48 B |

FOREIGN PATENT DOCUMENTS

| | | | |
|---|---|---|---|
| EP | 0987413 | A2 | 3/2000 |
| JP | 11-193723 | A | 7/1999 |
| JP | 2004-360773 | A | 12/2004 |
| WO | WO-2005/111395 | A2 | 11/2005 |

* cited by examiner

ACCESSORIES ARRANGEMENT STRUCTURE OF INTERNAL COMBUSTION ENGINE FOR MOTORCYCLE

CROSS-REFERENCE TO RELATED APPLICATIONS

The present application claims priority under 35 USC 119 to Japanese Patent Application No. 2006-052763 filed on Feb. 28, 2006 the entire contents of which are hereby incorporated by reference.

BACKGROUND OF THE INVENTION

1. Field of the Invention

The present invention relates to an accessories arrangement structure for an internal combustion engine of a motorcycle where accessories such as an oil cooler, an oil filter and a balancer are arranged in a lower part of a crankcase.

2. Description of Background Art

An internal combustion engine is disclosed in JP-A No. 2004-360773.

In the internal combustion engine disclosed in JP-A No. 2004-360773, a crankcase is vertically partitioned and an oil cooler, an oil filter and a balancer are provided in a lower crankcase.

The oil cooler is arranged close to the center of the front of the lower crankcase and the balancer is arranged next to the left side of an oil cooler housing to which the oil cooler is attached. However, the oil filter is arranged on the right side of the lower crankcase.

As the oil cooler and the oil filter project from the lower crankcase and particularly, the oil filter projects from the right side of the lower crankcase, it comes into question to secure a banking angle in the case of a motorcycle. In addition, when a mounting seat of the oil filter is formed as close to the center as possible to secure a sufficient banking angle, the layout of the inside of the internal combustion engine is restricted.

Accessories such as the oil cooler, the oil filter and the balancer are heavy. The oil filter is arranged on the right side of the lower crankcase and is apart from the oil cooler and the balancer respectively that are close to the center. Thus, the heavy accessories are dispersed. By this construction, the overhanging parts of the arrangement of the accessories of the internal combustion engine are dispersed, and the whole internal combustion engine is large in size.

SUMMARY AND OBJECTS OF THE INVENTION

The invention is made in view of such a problem. It is an object of an embodiment of the present invention to provide an accessories arrangement structure for an internal combustion engine for a motorcycle where constraints on the layout of the inside of an internal combustion engine are reduced. Thus, a banking angle is secured and a degree of freedom of the layout is increased. Heavy accessories and an overhanging part of the internal combustion engine are concentrated. Thus, the maneuverability of the vehicle is enhanced and the whole internal combustion engine can be small in size.

According to an embodiment of the present invention, an internal combustion engine for a motorcycle is provided where an oil cooler and an oil filter are arranged together with a balancer in a lower part and in the front of a crankcase that journals a crankshaft directed in a vehicular width direction, wherein the oil cooler and the oil filter are attached to the front in a vehicular traveling direction of the crankcase that project, in a front view of the vehicle, the balancer, the oil cooler and the oil filter are adjacent to each other and are arranged abreast in parallel with the crankshaft.

According to an embodiment of the present invention, for the accessories arrangement structure of the internal combustion engine for the motorcycle, in a side view of the vehicle in a direction of the crankshaft, an oil cooler housing of the oil cooler and an oil filter housing of the oil filter are arranged so that they are overlapped with the balancer.

According to an embodiment of the present invention, the accessories arrangement structure of the internal combustion engine provides a balancer lubricating oil communicating passage that is formed for communicating the oil cooler housing with a balancer chamber.

According to an embodiment of the present invention, the internal combustion engine is an in-line multi-cylinder internal combustion engine in which plural cylinders are arranged in series, a piston cooling oil passage for jetting oil to a piston from an oil jet formed on a passage is arranged on an axis parallel to the crankshaft, the oil cooler is attached to an oil cooler housing formed in the vicinity of the center in a cylinder array direction of the crankcase, and a piston cooling oil communicating passage for communicating an inlet in the center in the cylinder array direction of the piston cooling oil passage with the oil cooler housing is formed.

According to the accessories arrangement structure of the internal combustion engine for the motorcycle in an embodiment of the present invention, as the oil cooler and the oil filter are arranged together with the balancer in the lower part and in the front of the crankcase that journals the crankshaft directed in the vehicular width direction, and the oil cooler and the oil filter are attached to the front in the vehicular traveling direction of the crankcase with them projecting, the oil cooler and the oil filter have no effect upon the banking angle, constraints on the layout of the inside of the internal combustion engine are reduced, and a degree of the freedom of the layout can be increased.

In addition, as the balancer, the oil cooler and the oil filter in an embodiment of the present invention are adjacent and are arranged abreast in parallel with the crankshaft in the lower part and in the front of the crankcase in the front view of the vehicle, heavy accessories are concentrated and the maneuverability of the vehicle can be enhanced. In addition, as the overhanging parts such as the oil cooler and the oil filter of the internal combustion engine can be concentrated, the whole internal combustion engine can be constructed to be compact.

According to the accessories arrangement structure of the internal combustion engine for the motorcycle in an embodiment of the present invention, as the oil cooler housing of the oil cooler and the oil filter housing of the oil filter are arranged with them overlapped with the balancer in the side view of the vehicle in the direction of the crankshaft, a rate at which the oil cooler and the oil filter project in front in the vehicular traveling direction can be possibly reduced and the whole internal combustion engine can be more compact.

The oil cooler housing is provided with a seat for mounting the oil cooler with an inflow port and an outflow port respectively for directly delivering and receiving oil to/from the oil cooler being formed therein. Similarly, the oil filter housing is provided with a seat for mounting the oil filter, wherein an inflow port and an outflow port for directly delivering and receiving oil to/from the oil filter are formed.

According to the accessories arrangement structure of the internal combustion engine for the motorcycle in an embodiment of the present invention, as the balancer lubricating oil communicating passage for communicating the adjacent oil cooler housing with the adjacent the balancer chamber is formed, the balancer lubricating oil communicating passage for supplying oil for lubricating a shaft of the balancer can be possibly reduced. Thus, the oil, immediately after the oil passes the oil cooler, is directly supplied to the balancer through the short balancer lubricating oil communicating passage, to permit pump loss to be reduced.

According to the accessories arrangement structure of the internal combustion engine for the motorcycle according to an embodiment of the present invention, as the inlet of the piston cooling oil passage and the oil cooler housing respectively located in the center of the cylinder array direction communicate via the piston cooling communicating passage, the piston cooling oil communicating passage for supplying oil for cooling the piston can be possibly reduced. Thus, the incoming radiational area on the way of the supply of oil is reduced. Oil possibly kept at a low temperature is taken into the piston cooling oil passage from the inlet in the center in the cylinder array direction, and the oil can be substantially uniformly jetted to each piston from each oil jet.

Therefore, each piston can be effectively cooled impartially.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
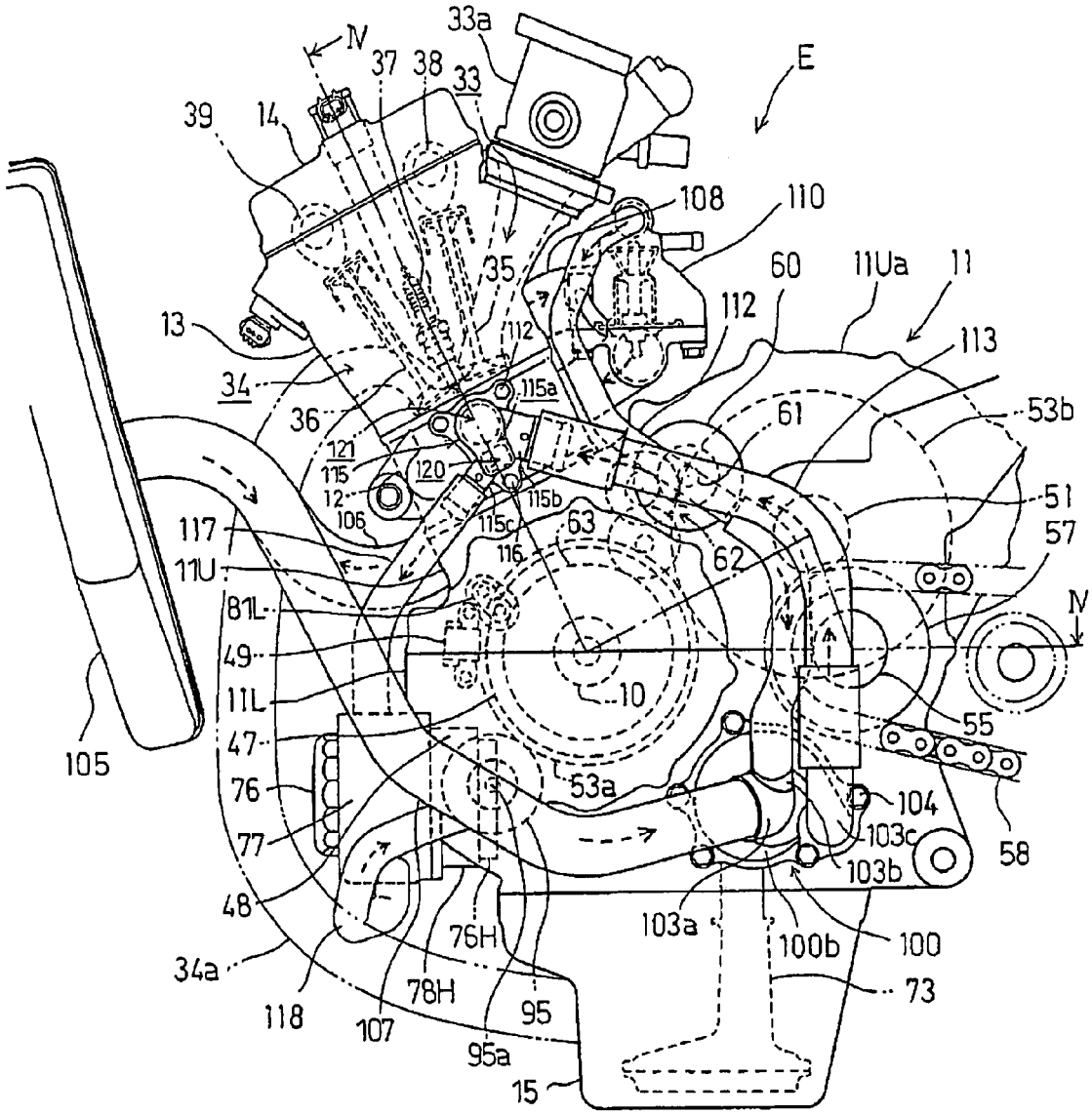
FIG. 1 is a left side view showing an internal combustion engine equivalent to one embodiment of the invention.

Referring to FIGS. 1 to 10, one embodiment of the invention will be described below.

An internal combustion engine E in this embodiment is an in-line four-cylinder water-cooled internal combustion engine where four cylinders are arranged in series and is mounted in a motorcycle transversely with a crankshaft 10 directed sideways.

In this description, a forward direction of the vehicle shall be forward, a reverse direction shall be backward, a leftward direction in the forward direction shall be leftward, and a rightward direction shall be rightward.

A crankcase 11 that journals the crankshaft 10 is vertically divided with four cylinders 12*c* being arrayed in series on an upper crankcase 11U, a cylinder block 12 and a cylinder head 13 respectively that are integrated to be overlapped and are arranged to be tilted slightly forward. The cylinder head 13 is covered with a cylinder head cover 14.

In the meantime, an oil pan 15 is attached under a lower crankcase 11L.

Figure 4:
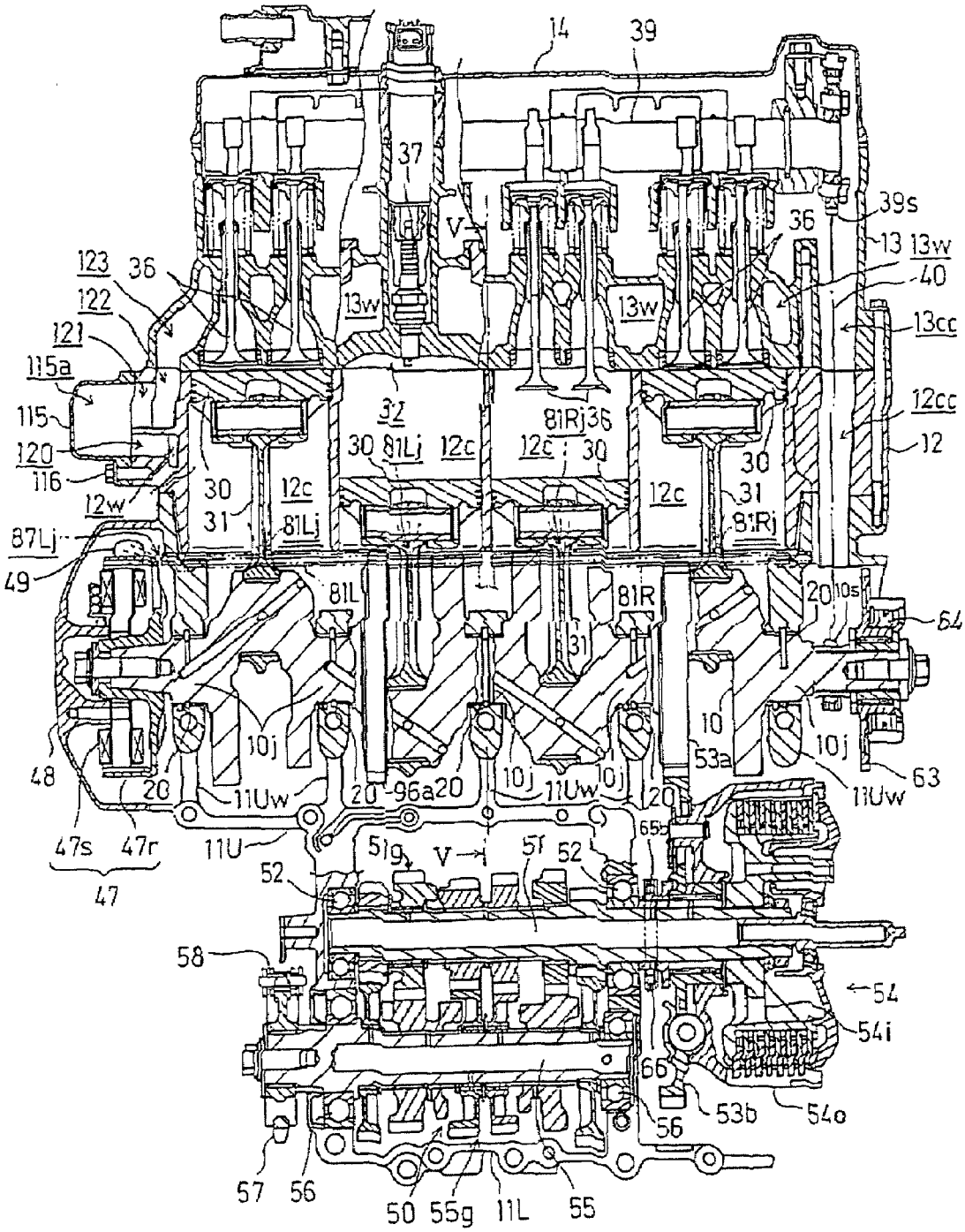
FIG. 4 is a sectional view viewed along a line IV-IV in FIG. 1.
Figure 5:
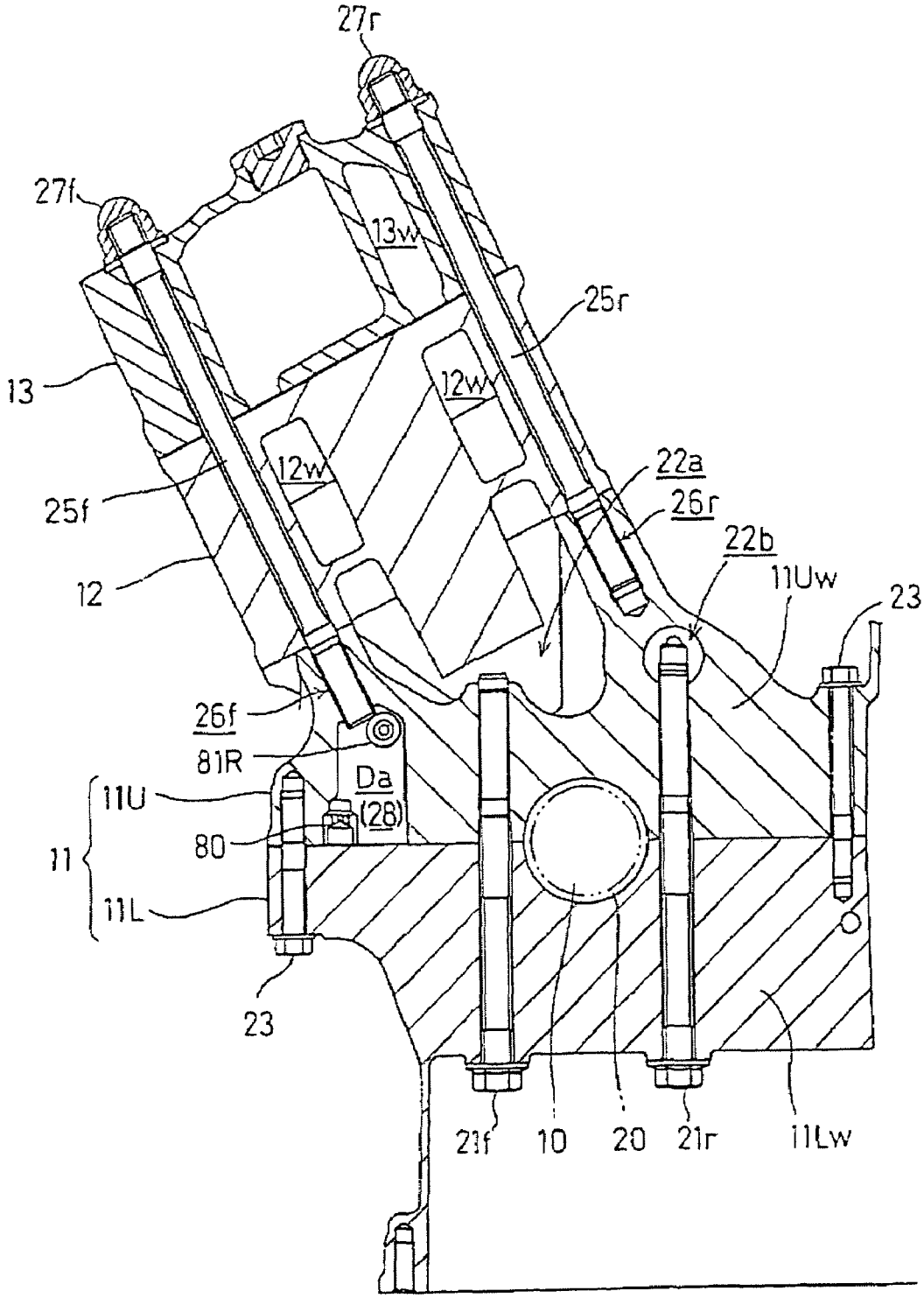
FIG. 5 is a schematic sectional view viewed along a line V-V in FIG. 4.

Referring to FIGS. 4 and 5, each journal wall 11Uw, 11Lw of the upper crankcase 11U and the lower crankcase 11L supports a journal 10*j* of the crankshaft 10 via a main bearing 20 with the journal vertically held between the journal walls for journaling the crankshaft 10 so that the crankshaft 10 can be rotatably journalled.

As the internal combustion engine according to an embodiment of the invention is an in-line 4-cylinder internal combustion engine E, the crankshaft 10 is provided with five journals 10*j* and each is rotatably supported by upper and lower five journal walls 11Uw, 11Lw of the upper crankcase 11U and the lower crankcase 11L for supporting the crankshaft 10.

The upper crankcase 11U and the lower crankcase 11L are integrally fastened by bolts by joining respective faces.

Referring to FIG. 5, in each of the five journal walls 11Uw, 11Lw of the upper crankcase 11U and the lower crankcase 11L, stud bolts 21*f*, 21*r* pierce the lower crankcase 11L straight upwardly from the downside with semicircular parts holding the crankshaft 10 between the stud bolts. The stud bolts 21*f*, 21*r* are screwed into long tapped holes of the upper crankcase 11U and are tightened.

The end of the stud bolt 21*f* on the front side project into a cavity 22*a* of the crankcase after the stud bolt is screwed into the tapped hole of the upper crankcase 11U. The end of the stud bolt 21*r* on the rear side also projects into a circular hole 22*b* bored in parallel with the crankshaft 10 in the upper crankcase 11U after the stud bolt is screwed into the tapped hole of the upper crankcase 11U.

Therefore, the concentration in a part of stress which is caused by screwing and tightening the stud bolts 21*f*, 21*r* and which acts on the vicinity of the tapped holes can be reduced.

The upper crankcase 11U and the lower crankcase 11L are fastened not only by the stud bolts 21*f*, 21*r* but by a plurality of bolts 23 in required locations (see FIG. 5).

The cylinder block 12 is superimposed on the upper crankcase 11U by mutually joining faces in a state in which the cylinder block is a little tilted forward. The cylinder head 13 is superimposed on the cylinder block 12 with front and rear stud bolts 25*f*, 25*r* piercing the cylinder block 12 that adjoins the journal wall 11Uw of the upper crankcase 11U and the cylinder head 13 from the upside. The stud bolts are screwed into tapped holes 26*f*, 26*r* bored in the upper crankcase 11U, and the cylinder block and the cylinder head are integrally fastened.

The lower ends of the stud bolts 25*f*, 25*r* are screwed into the tapped holes 26*f*, 26*r* bored on the joined face of the upper crankcase 11U with the stud bolts 25*f*, 25*r* projecting upward in an embedding state. Through holes of the cylinder block 12 are fitted to the stud bolts 25*f*, 25*r* with the cylinder block 12 being superimposed on the joined face of the upper crankcase 11U. Thereafter, through holes of the cylinder head 13 are fitted to the stud bolts 25*f*, 25*r* that pierce the through holes of the cylinder block 12 and project therefrom. The cylinder head 13 is superimposed on an upper joined face of the cylinder block 12.

The stud bolts 25*f*, 25*r* are further screwed into the tapped holes 26*f*, 26*r* together with the cap nuts 27*f*, 27*r* by screwing cap nuts 27*f*, 27*r* on male screws at the upper ends of the stud bolts 25*f*, 25*r* that pierce the through holes of the cylinder head 13 and are project therefrom and tightening them. The cylinder block 12 and the cylinder head 13 are integrally fastened to the upper crankcase 11U.

A cavity 28 is formed in the three journal walls 11Uw in the center of the upper crankcase 11U so that the cavity is open to the joined face of the case and the front tapped hole 26*f* passes the joined face to the cylinder block 12 and reaches the cavity 28.

The stud bolt 25*f* that pierces the cylinder head 13 and the cylinder block 12 is screwed into the tapped hole 26*f* and the end is open to the cavity 28.

Therefore, the concentration with respect to stress which is caused by screwing and tightening the stud bolt 25*f* and which acts in the vicinity of the tapped hole in the upper crankcase 11U can be reduced.

As described above, a piston 30 is fitted into each cylinder bore 12*c* of four cylinders of the cylinder block 12 integrally fastened to the upper crankcase 11U so that the piston 30 can be reciprocated and is coupled to the crankshaft 10 via a connecting rod 31.

In the cylinder head 13, every cylinder bore 12*c* includes a combustion chamber 32 that is formed opposite to the piston 30 with an intake port 33 which is open to the combustion chamber 32 and which is opened and closed by a pair of intake valves 35 that extend rearwardly. An exhaust port 34 which is opened and closed by a pair of exhaust valves 36 extends forward, and further, an ignition plug 37 is installed opposite to the combustion chamber 32.

A throttle body 33*a* is coupled to an opening on the upstream side of the intake port 33 with an intake pipe, not shown, being coupled on the upstream side of the throttle body, and an exhaust pipe 34*a* (shown by an imaginary line in FIG. 1) being coupled to an opening on the downstream side of the exhaust port 34.

Each intake valve 35 and each exhaust valve 36 are opened and closed in synchronization with the rotation of the crankshaft 10 by an intake camshaft 38 and an exhaust camshaft 39 rotatably journalled by the cylinder head 13.

Figure 2:
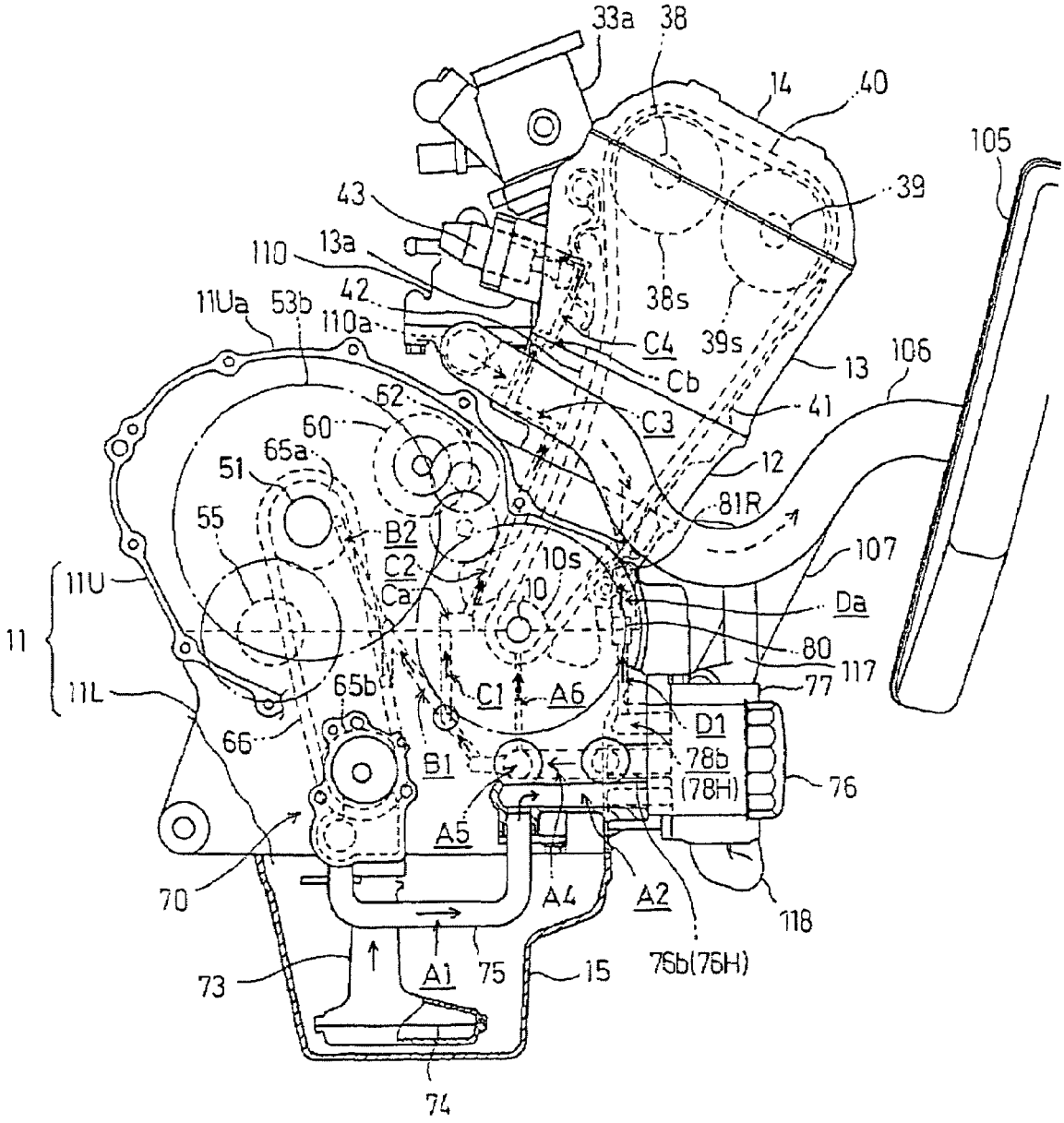
FIG. 2 is a right side view showing a section of the same part.

Therefore, cam sprockets 38*s*, 39*s* are fitted to right ends of the camshaft 38, 39 with a timing chain 40 being positioned between a drive sprocket 10*s* fitted in the vicinity of the right end of the crankshaft 10 and each cam sprocket 38*s*, 39*s* (see FIGS. 2 and 4). The timing chain is driven at a revolving speed equivalent to a half of the revolving speed of the crankshaft 10.

Cam chain chambers 12*cc*, 13*cc* for arranging the timing chain 40 are formed at the right ends of the cylinder block 12 and the cylinder head 13 (see FIG. 4) with cam chain guides 41, 42 being provided in the cam chain chambers 12*cc*, 13*cc* along the timing chain 40 before and behind. The rear cam chain guide 42 is pressed by a hydraulic type cam chain tensioner 43 for pressing the timing chain 40 and for applying suitable tension (see FIG. 2).

The cam chain tensioner 43 is attached to a tensioner fixing boss 13*a* projecting backward from a rear face of the right end of the cylinder head 13 as shown in FIG. 2.

In the meantime, referring to FIG. 4, an outer rotor 47*r* of an AC generator 47 is fitted to the left end of the crankshaft 10 that projects leftward from the leftmost journal walls 11Uw, 11Lw forming the left side wall of the crankcase 11. An inner stator 47*s* is provided with a magneto coil of the AC generator 47 that is supported by a generator cover 48 covering the AC generator 47 from the left side, and is arranged in the outer rotor 47*r*.

A pulser coil 49 which functions as an engine speed detector for detecting the number of revolutions of the crankshaft 10 is arranged near to the front of the outer periphery of the outer rotor 47*r* of the AC generator 47 in the generator cover 48.

A transmission 50 is arranged at the back of the crankshaft 10 in the crankcase 11.

The transmission 50 is a constant-mesh type gear transmission with a main shaft 51 that is journalled to the upper crankcase 11U via a bearing 52 so that the main shaft can be rotated on the diagonal upside at the back of the crankshaft 10. A counter shaft 55 is journalled via a bearing 56 so that the counter shaft can be rotated with the counter shaft held between the joined faces of the upper crankcase 11U and the lower crankcase 11L at the back of the crankshaft 10 with opposite gears forming a pair in speed change gear groups 51*g*, 55*g* mounted on the main shaft 51 and the counter shaft 55 respectively parallel to the crankshaft 10 are engaged, each gear is fitted to the shaft via a spline. The speed is changed by the shift of gears by a shift mechanism functioning as a shifter.

A multiple disc friction clutch 54 is provided at the right end of the main shaft 51 with a primary driven gear 53*b* supported by a clutch outer 54*o* of the friction clutch 54 so that the primary driven gear is rotated together with the clutch outer. A primary drive gear 53*a*, formed in a crank web on the rightmost side of the crankshaft 10, is engaged for configuring a primary deceleration mechanism.

A clutch inner 54*i* on the output side of the friction clutch 54 is fitted to the main shaft 51 via a spline and therefore, the rotation of the crankshaft 10 is transmitted to the main shaft 51 via the primary deceleration mechanisms 53*a*, 53*b* and the friction clutch 54.

The rotation of the main shaft 51 is transmitted to the counter shaft 55 via the engagement of the speed change gear groups 51*g*, 55*g*.

The counter shaft 55 also function as an output shaft, an output sprocket 57 is fitted at the left end that pierces the crankcase 11 to the left and projects outside, a transmission chain 58 is placed between the output sprocket and a driven sprocket of a rear wheel not shown. Thus, a secondary deceleration mechanism is configured, and motive power is transmitted to the rear wheel via the secondary deceleration mechanism.

As shown in FIG. 4, a driven gear for starting 63 is journalled via a one-way clutch 64 on the right side of the drive sprocket 10*s* on the crankshaft 10.

Figure 3:
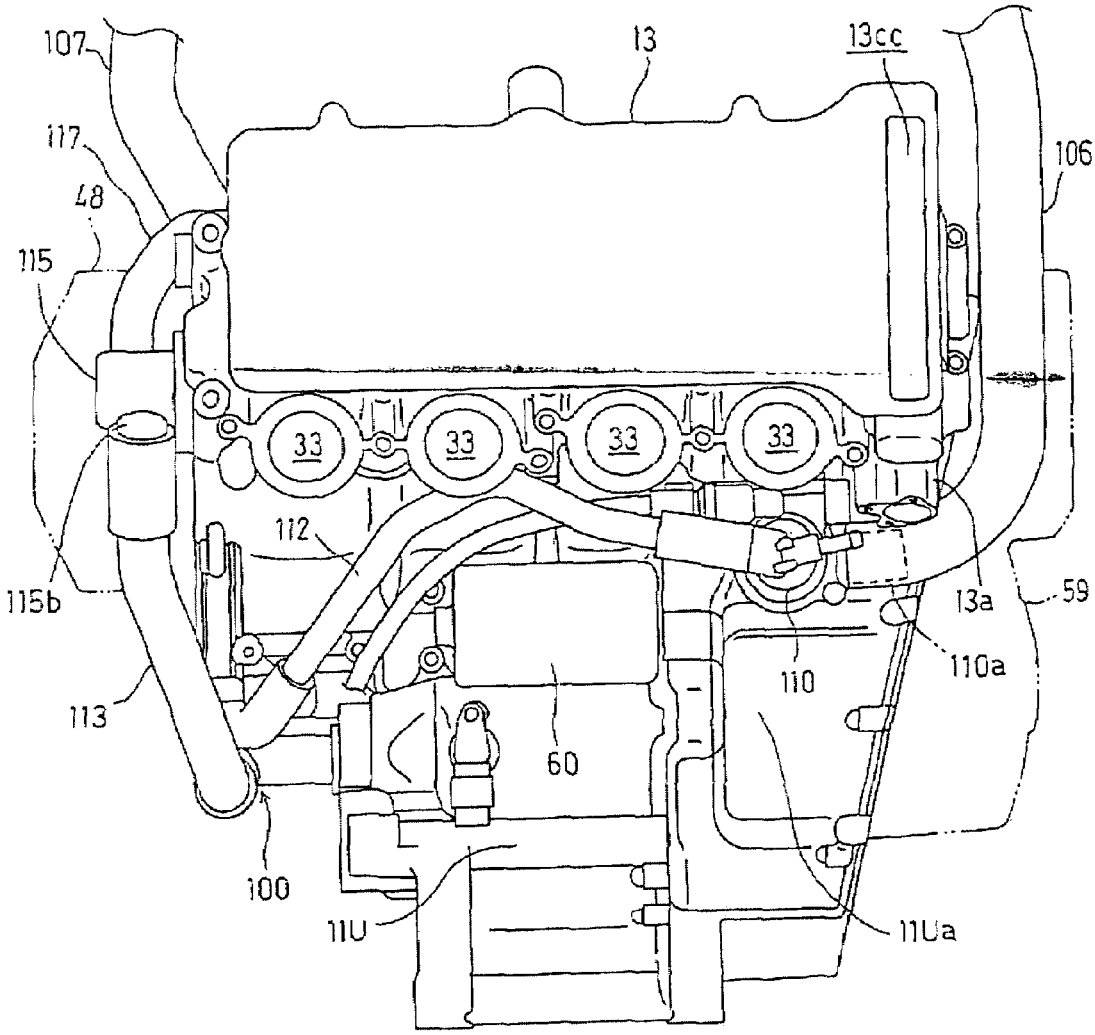
FIG. 3 is a plan in which the same part is omitted.

A starter motor 60 that starts the internal combustion engine E is attached to an upper face of the center of the crankcase 11 as shown in FIG. 3.

A right part of an upper wall at the back of a part to which the cylinder block 12 is connected of the upper crankcase 11U greatly overhangs upward to house the friction clutch 54. The primary driven gear 53*b* and the starter motor 60 is attached along the left side of the overhanging part 11Ua.

The right side of the friction clutch 54 is covered with a clutch cover 59 (see FIG. 3).

A driving gear shaft 61 projecting on the right side of the starter motor 60 pierces a side wall of the overhanging part 11Ua of the upper crankcase 11U to the inside thereof. A speed reducing gear mechanism 62 is inserted between the driving gear shaft 61 and the driven gear 63 for starting the engine E.

Therefore, the speed of the revolution of the driving gear shaft 61 by the drive of the starter motor 60 is reduced by the speed reducing gear mechanism 62 and the revolution is transmitted to the driven gear 63 for starting the engine E. Thus, the revolution of the driven gear 63 for starting the engine E is transmitted to the crankcase 10 via the one-way clutch 64, and the internal combustion engine E is started.

As shown in FIG. 4, a drive sprocket 65*a* is rotatably journalled next to the left side of the primary driven gear 53*b* of the main shaft 51. An extended projection of the drive sprocket 65*a* is fitted into a hole of the primary driven gear 53*b*, and the drive sprocket is turned integrally with the primary driven gear 53*b*.

Figure 6:
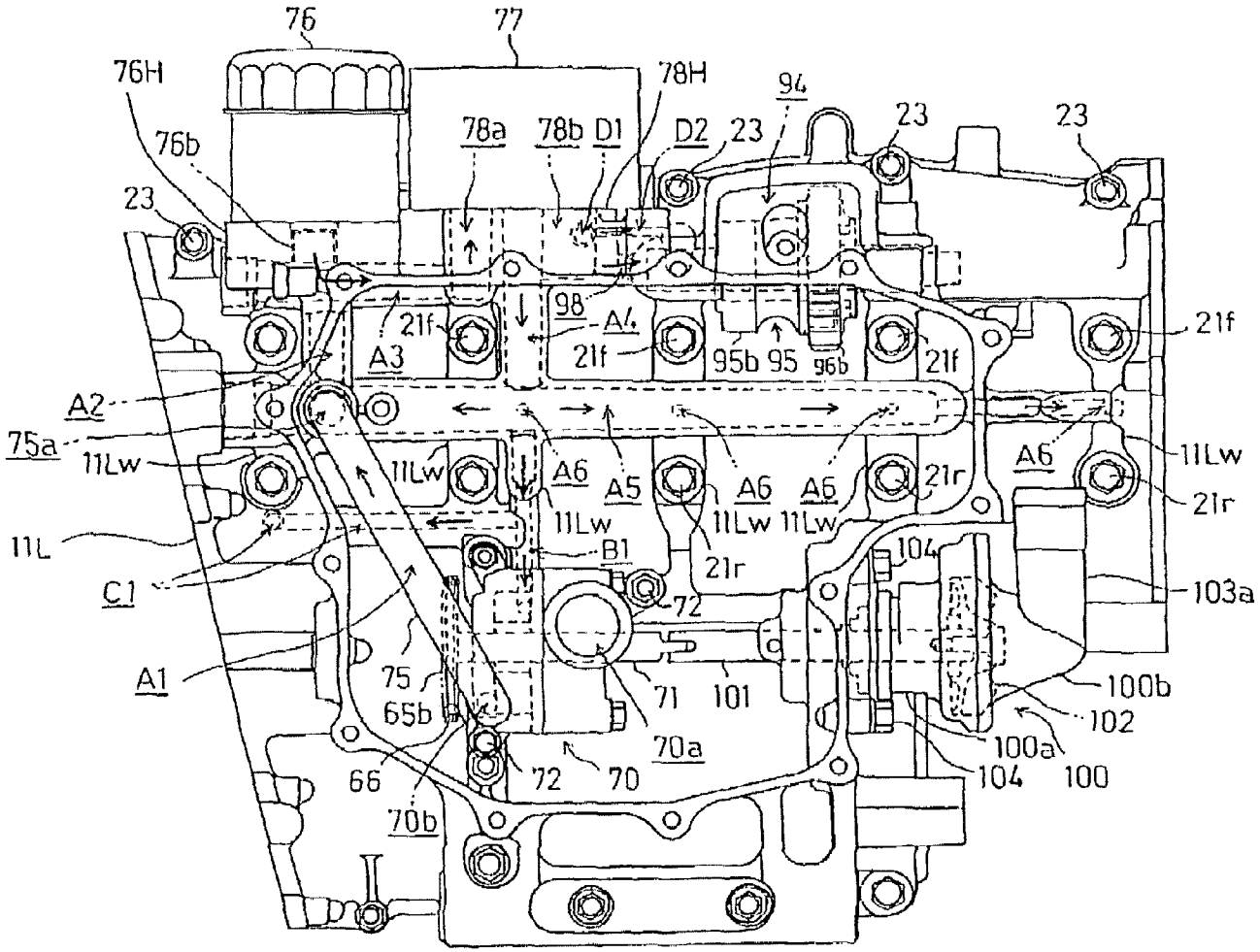
FIG. 6 is a bottom view showing a crankcase.

Referring to FIG. 6 which is a bottom view showing the crankcase 11, an oil pump 70 and a water pump 100 are attached to the lower crankcase 11L with them laterally arranged on the downside of the main shaft 51.

The oil pump 70 on the right side (on the left side in FIG. 6) is attached to the inside of the lower crankcase 11L by bolts 72 from the downside, the water pump 100 on the left side (on the right side in FIG. 6) is attached to a left side wall of the lower crankcase 11L by bolts 104 by fitting it from the outside. A drive shaft 71 projecting on the left side of the oil pump 70 is coaxially coupled to a drive shaft 101 projecting on the right side of the water pump 100.

The drive shaft 71 of the oil pump 70 also projects rightward and a driven sprocket 65*b* is fitted to its right end.

The drive sprocket 65*a* provided to the main shaft 51 is located above the driven sprocket 65*b* and an endless chain 66 is positioned between the drive sprocket 65*a* and the driven sprocket 65*b* (see FIG. 2).

Therefore, the rotation of the crankshaft 10 is transmitted from the drive sprocket 65*a* integrated with the primary driven gear 53*b* of the primary deceleration mechanism to the driven sprocket 65*b* via the endless chain 66 and rotates the drive shaft 71 of the oil pump 70 and the drive shaft 101 of the water pump 100 together with the driven sprocket 65*b*. Referring to FIG. 6 showing the lower crankcase 11L, a balancer chamber 94 is formed between the front of the central journal wall 11Uw corresponding to the cylinder on the center side and the front of the journal wall 11Uw adjacent on the left side (on the right side in FIG. 6) of the above-mentioned journal wall, both ends of a balancer shaft 95*a* are supported by the right and left journal walls 11Uw, 11Uw in the balancer chamber 94, and a secondary balancer 95 is installed.

The secondary balancer 95 is located in a downward diagonal front of the crankshaft 10 in the side view shown in FIG. 1.

Figure 7:
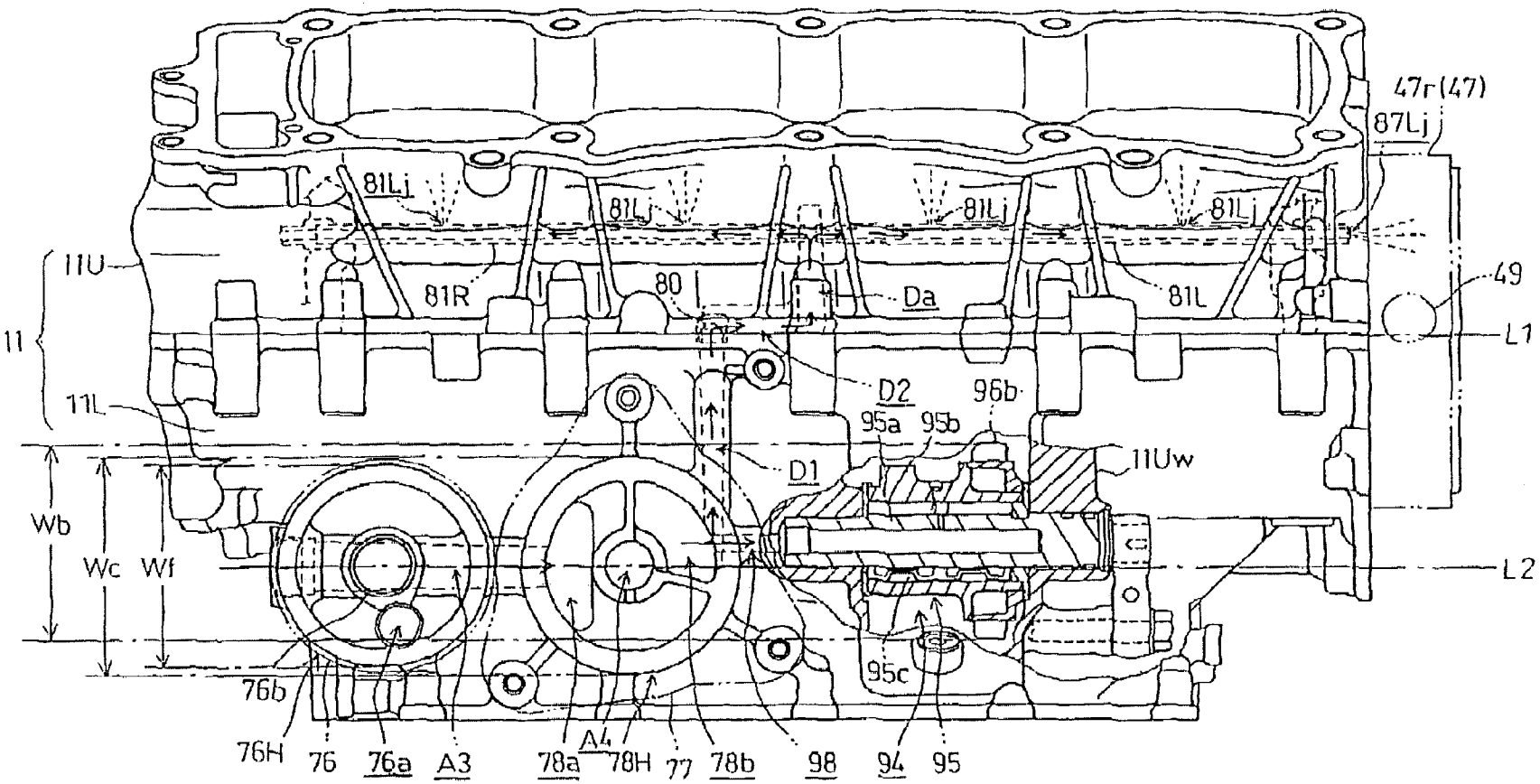
FIG. 7 is a front view showing the crankcase.

Referring to FIG. 7 which is a front view showing the crankcase 11, as to the secondary balancer 95, balance weight 95*b* is journalled by the balancer shaft 95*a* via a needle bearing 95*c* and a balancer driven gear 96*b* is mounted on an outer periphery of a boss of the balance weight 95*b*.

The balancer driven gear 96*b* of the secondary balancer 95 is engaged with a balancer drive gear 96*a* (see FIG. 4) having the double number of teeth of the balancer driven gear 96*b* formed in the crank web of the crankshaft 10.

Therefore, the balance weight 95*b* of the secondary balancer 95 is turned at the double revolution speed of the crankshaft 10 and the secondary balancer absorbs secondary vibration of the in-line four-cylinder internal combustion engine E.

The oil pump 70 which is a hydraulic supply source is a trochoid pump, an inner rotor integrated with the drive shaft 71 rotates an outer rotor engaged with the inner rotor in the vicinity of the inner rotor, and oil is taken and discharged depending upon the variation of volume between the rotors.

An inlet 70*a* of the oil pump 70 is open downward (see FIG. 6) with a suction pipe 73 being coupled to the inlet 70*a* and extending downward in the oil pan 15. An oil strainer 74 is arranged in a state in which the lower end is brought close to the bottom of the oil pan 15 (see FIG. 2).

Therefore, when the oil pump 70 is driven, oil that accumulates in the oil pan 15 is directed to the suction pipe 73 via the oil strainer 74 and is pumped up.

The discharge port 70*b* of the oil pump 70 is also open downwardly, as shown in FIGS. 2 and 6. One end of the oil supply pipe 75 forming the first oil supply passage A1 is coupled to the discharge port 70*b* with the oil supply pipe 75 extending on the diagonal right side (on the left side in FIG. 6) in front after being detoured downwardly in the oil pan 15. The oil filter 76 projects on a mounting seat opposite to the front of an oil filter housing 76H formed in the vicinity of a right end of the front of the lower crankcase 11L. The other end of the oil supply pipe is coupled to an inlet 75*a* (see FIG. 6) open on the downside of the end of a second oil supply passage A2 bored rearwardly from an inflow port 76*a* (see FIG. 7) for making oil flow into the oil filter 76 of the oil filter housing 76H.

Referring to FIGS. 6 and 7, an oil cooler 77 projects abreast in the vicinity of the center in a direction of the array of the cylinders on the left side (on the right side in FIGS. 6, 7) of the oil filter 76 arranged in the vicinity of the right end in the front of the lower crankcase 11L. An oil cooler housing 78H, including an inflow port 78*a* and an outflow port 78*b* of the oil cooler 77, is formed in a part to which the oil cooler 77 is attached in the front of the lower crankcase 11L.

The balancer 95 is arranged next to the balancer chamber 94 on the left side of the oil cooler housing 78H formed in the vicinity of the center in the direction of the array of the cylinders (see FIGS. 6 and 7).

As shown in FIG. 7, in a front view showing the crankcase 11, the secondary balancer 95, the oil cooler 77 and the oil filter 76 are adjacent and are arranged in parallel with the crankshaft 10.

More specifically, referring to FIG. 7, the secondary balancer 95, the oil cooler 77 and the oil filter 76 are adjacent and are arranged in parallel with the crankshaft 10 so that they are in an area where the maximum outside diameter width Wb of the secondary balancer 95 (the outside diameter width of the balancer driven gear 96*b*), the outside diameter width Wc of the oil cooler 77 (the outside diameter width of the oil cooler housing 78H) and the outside diameter width Wf of the oil filter 76 (the outside diameter width of the oil filter housing 76H) are all overlapped based upon a central axis L1 of the crankshaft 10.

In this embodiment, particularly in the front view showing the crankcase 11 in FIG. 7, a straight line L2 tying each center of the oil filter 76 and the oil cooler 77 is overlapped with the balancer shaft 95*a* of the secondary balancer 95 and is parallel to the central axis L1 of the crankshaft 10.

As described above, as the secondary balancer 95, the oil cooler 77 and the oil filter 76 are adjacent in a front view of the vehicle and are arranged abreast in parallel with the crankshaft in a lower part and in the front of the lower crankcase 11L, the secondary balancer 95, the oil cooler 77 and the oil filter 76 which all provide a heavy concentration, the maneuverability of the vehicle can be enhanced by the concentration of mass, and as overhanging parts such as the oil cooler 77 and the oil filter 76 of the internal combustion engine can be concentrated, the whole internal combustion engine E can be compacted.

As the oil filter 76 arranged in the vicinity of the right end projects abreast with the oil cooler 77 in the front of the lower crankcase 11L without projecting from the side of the lower part of the crankcase as in the related art, constraints on the layout of the inside of the internal combustion engine E are reduced without having an effect upon a banking angle and a degree of the freedom of the layout can be increased.

Further, in the side view of the vehicle shown in FIG. 1 in which the internal combustion engine E is viewed with the crankshaft in the center, as the oil cooler housing 78H of the oil cooler 77 and the oil filter housing 76H of the oil filter 76 are arranged so that they are overlapped with the secondary balancer 95, a rate at which the oil cooler 77 and the oil filter 76 project from the front in the direction in which the vehicle advances can possibly be reduced. Thus, a degree in the freedom of the piping of the exhaust pipe 34*a* can be enhanced, and the whole internal combustion engine E can be more compacted.

As shown in FIG. 6, an outflow cylinder (an outflow port) 76*b* projects rearwardly of the oil filter 76 and communicates with a third oil supply passage A3 bored sideways. In addition, the third oil supply passage A3 communicates with the inflow port 78*a* of the oil cooler housing 78H.

A fourth oil supply passage A4 is bored rearwardly from the outflow port 78*b* in the center of the oil cooler housing 78H (see FIGS. 6 and 7).

A main gallery A5 which is a fifth oil supply passage is bored in parallel with the crankshaft 10 on the downside of the crankshaft 10 so that the main gallery is perpendicular to the fourth oil supply passage A4.

The main gallery A5 pierces the five journal walls 11Lw of the lower crankcase 11L and an oil branch supply passage A6 is bored toward each journal bearing in each journal wall 11Lw.

Referring to FIG. 2, an oil supply passage B1 for supplying oil diagonally upwardly to the side of the transmission 50 at the back from the rear end of the oil supply passage A4 is bored and an oil supply passage B2 for supplying oil to a bearing of the main shaft 51 in the upper crankcase 11U is bored in continuity to the oil supply passage B1.

Referring to FIGS. 2 and 6, a first oil supply passage C1 for supplying oil to the cam chain tensioner 43 to the right on the way of the oil supply passage B1 in the lower crankcase 11L is also bored with the first oil supply passage branched, reaches the rightmost journal wall 11Lw, is bent upwardly from its right end, and is open to the joined face.

A recessed portion having a suitable volume is made on the joined face of the rightmost journal wall 11Uw of the upper crankcase 11U opposite to an opening of the first oil supply passage C1 and the recessed portion functions as an oil reservoir Ca because an opening of the recessed portion is covered by the joined face of the journal wall 11Lw of the lower crankcase 11L except the opening of the first oil supply passage C1.

A second oil supply passage C2 is bored diagonally toward the face joined to the cylinder block 12 from the oil reservoir Ca along the joined face of the journal wall 11Uw in the upper crankcase 11U.

The second oil supply passage C2 is connected to a third oil supply passage C3 bored in the rear of the right side wall of the cylinder block 12.

The third oil supply passage C3 in the cylinder block 12 is bent once rearwardly and is bent again after the third oil supply passage is bored in an axial direction of the cylinder from the face joined to the upper crankcase 11U and communicates with a fourth oil supply passage C4 bored in the cylinder head 13 through labyrinth structure Cb formed on the face joined to the cylinder head 13.

The fourth oil supply passage C4 is bent in an L-shape, is connected to an inflow port of the cam chain tensioner 43, and supplies oil to the cam chain tensioner 43.

The labyrinth structure Cb on the way means a labyrinth on the joined face between the cylinder block 12 and the cylinder head 13 and has effect as a filter.

In addition, referring to FIGS. 2 and 7, a first oil supply passage D1 for supplying oil for cooling the piston is bored to the right and upwardly from the outflow port 78*b* of the oil cooler housing 78H in the lower crankcase 11L up to the joined face on the upside.

A communicating hole 98 which is an oil communicating passage for lubricating the balancer communicates with the outflow port 78*b* of the oil cooler housing 78H and the balancer chamber 94 adjacent to the left side of the outflow port, oil is supplied to a needle bearing 95*c* of the balancer 95, and oil is supplied to lubricate the balancer 95 (see FIGS. 6 and 7).

As the oil cooler housing 78H and the balancer chamber 94 are adjacent, the communicating hole 98 for connecting both and supplying oil to lubricate the balancer 95 can possibly be reduced. Oil immediately after lubricating the oil cooler 77 is directly supplied to the balancer via the short communicating hole 98, and pump loss can be reduced.

The cavity 28 formed in the central journal wall 11Uw out of the five journal walls 11Uw of the upper crankcase 11U is open to the joined face of the case and a groove for a second oil supply passage D2 is formed up to a part where an opening of the cavity 28 in the center of the joined face of the upper crankcase 11U and the first oil supply passage D1 are opposite (see FIG. 7).

More particularly, the second oil supply passage D2 is formed so that a part of an opening of the groove formed in the upper crankcase 11U is covered with the joined face of the lower crankcase 11L.

A filter 80 having a plurality of small holes is installed at a connection of the joined face and the second oil supply passage D2 at an upper end of the first oil supply passage D1.

The filter 80 is formed by mechanical working or press working.

The cavity 28 with which the second oil supply passage D2 communicates and which is formed in the central journal wall 11Uw of the upper crankcase 11U is covered with the joined face of the lower crankcase 11L to be an oil reservoir Da that has suitable volume. In addition, the oil that is temporarily reserved though the oil reservoir is also a third oil supply passage.

As described above, as the oil reservoir Da is formed with the oil reservoir open to the joined face of the upper crankcase 11U, the oil reservoir Da can be simultaneously formed in casting the upper crankcase 11U and no mechanical working is required.

As the oil reservoir Da is formed because a part of the opening of the oil reservoir Da is closed by the joined face of the lower crankcase 11L, no dedicated cover member is separately required and the number of parts can be reduced.

As described above, referring to FIG. 5, as the tapped hole 26*f* is formed from the face joined to the cylinder head 13 in the cylinder block 12 to the oil reservoir Da, the stud bolt 25*f* that pierces the cylinder head 13 and the cylinder block 12 is screwed into the tapped hole 26*f* and a part of the end projects into the oil reservoir Da. Thus, the concentration in a part of stress that acts on the vicinity of the tapped hole of the upper crankcase 11U by screwing and tightening the stud bolt 25*f* can be reduced.

As this stress concentration reducing structure is formed utilizing the oil reservoir Da for stably supplying oil to oil jets 81Lj, 81Rj, 87Lj described later, no dedicated structure is separately required and the working for the structure is also not required.

Figure 8:
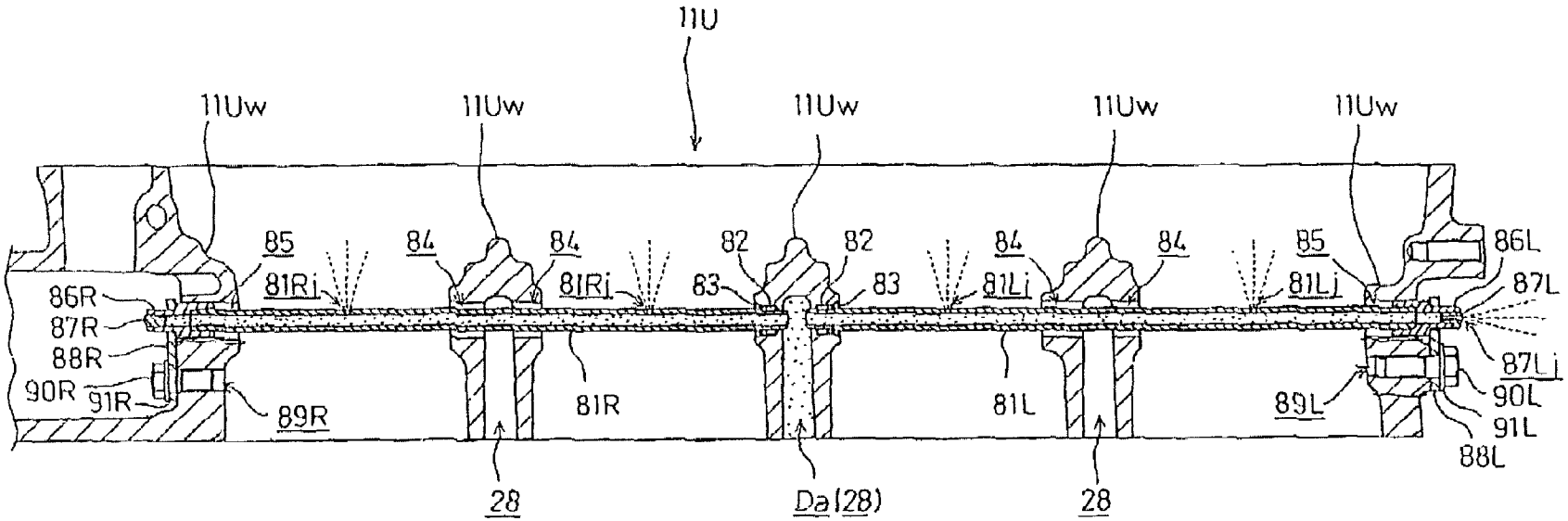
FIG. 8 is a sectional view showing an upper crankcase.
Figure 9:
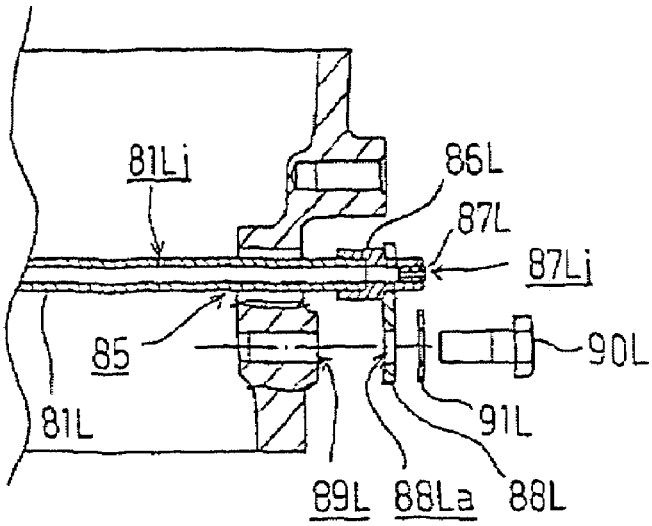
FIG. 9 is an exploded sectional view showing a part of the upper crankcase shown in FIG. 8.

Referring to FIG. 8, in a space on the upside of the oil reservoir Da, inner ends of the oil jet pipings 81L, 81R which are linear tube-like members and which are left and right oil passages for cooling each piston are fitted from both left and right sides and extend outside sideways on the axis parallel to the crankshaft 10 (in FIG. 8, the left and the right are reverse).

On the left and right oil jet pipings 81L, 81R, oil jets 81Lj, 81Rj for cooling each piston are bored opposite to the cylinder bore 12*c* on the upside in each intermediate position of the five adjacent journal walls 11Uw by two on each side.

Circular holes are coaxially formed in a predetermined position on the right and left side walls forming the oil reservoir Da, the inner ends of the left and right oil jet pipings 81L, 81R are fitted into the circular holes via collars 82, 82 and O-rings 83, 83, and an oil inlet which is an opening of the inner end is opposite to the oil reservoir Da.

The left and right oil jet pipings 81L, 81R pierce circular holes 84, 84 of both left and right journal walls 11Uw, 11Uw adjacent to the central journal wall 11Uw and their outer ends are inserted into circular holes 85, 85 formed in left and right outermost journal walls 11Uw, 11Uw.

The outer ends of the left and right oil jet pipings 81L, 81R are covered with cylindrical cap members 86L, 86R.

The cap members 86L, 86R are formed so that it axially has inside diameters in two sizes and outside diameters in two sizes and the oil jet pipings 81L, 81R are covered with the cap members 86L, 86R by press-fitting the oil jet pipings 81L, 81R into parts having larger inside diameters equal to outside diameters of the oil jet pipings 81L, 81R.

Parts having larger outside diameters of the cap members 86L, 86R are press-fitted into the circular holes 85, 85 formed in the left and right outermost journal walls 11Uw, 11Uw and the outer ends of the oil jet pipings 81L, 81R are fastened to and supported by the left and right outermost journal walls 11Uw, 11Uw via the cap members 86L, 86R.

A part of the parts having the larger outside diameters and parts having smaller outside diameters respectively of the cap members 86L, 86R project outside.

A cylindrical oil jet member 87L at the end of which an oil jet 87Lj for cooling the generator is formed is press-fitted, as an oil jet hole, into an outside opening of the smaller inside diameter part of the left cap member 86L and a plug member 87R is press-fitted into an outside opening of the smaller inside diameter part of the right cap member 86R to close the opening.

Circular holes 88La, 88Ra at bases of plate fitting stays 88L, 88R are press-fitted into the parts having the smaller outside diameters and project outside of the cap members 86L, 86R.

Clamping bolts 90L, 90R are screwed and tightened via washers 91L, 91R from the outside after circular holes 88La, 88Ra at bases of the fitting stays 88L, 88R are aligned with tapped holes 89L, 89R formed in each predetermined position of the left and right outermost journal walls 11Uw, 11Uw.

As for a method of mounting the left oil jet piping 81L, first, the fitting stay 88L is integrally fastened to the outer end of the oil jet piping 81L via the cap member 86L beforehand while maintaining a predetermined relative positional relation.

Figure 10:
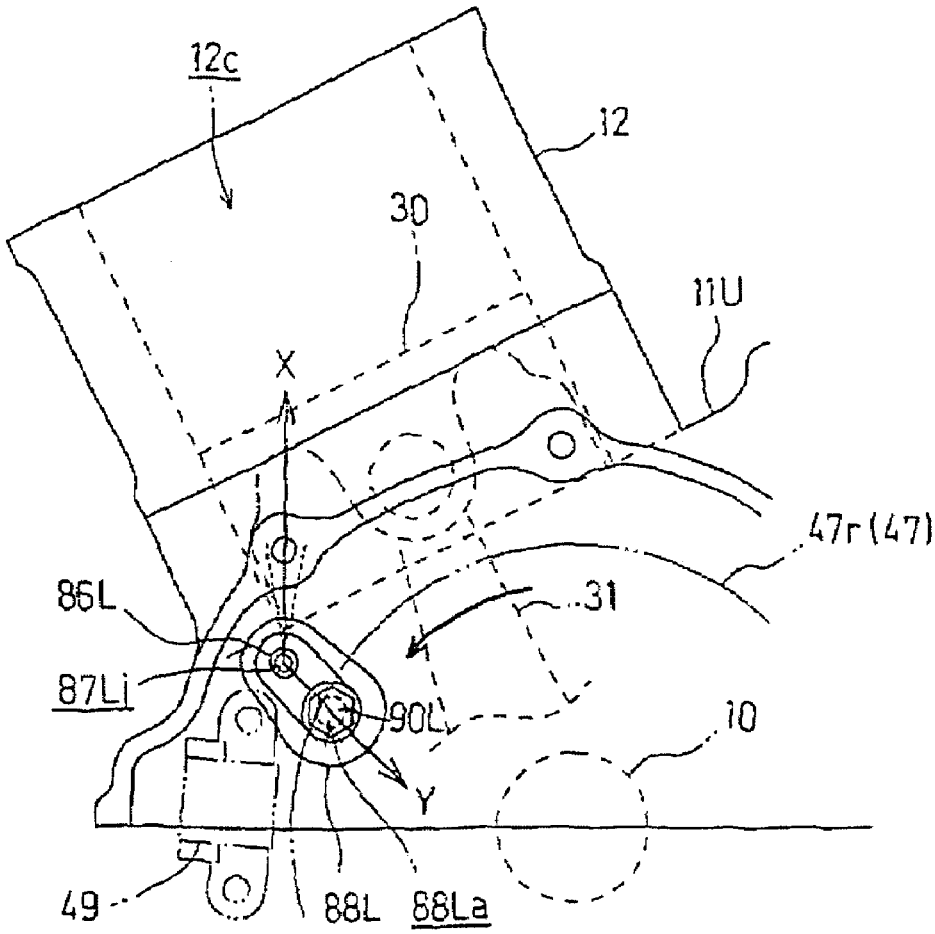
FIG. 10 is a side view showing a main part in which a part of the upper crankcase is omitted and showing the arrangement structure of an oil jet piping.

More specifically, as shown in FIG. 10, the oil jet piping 81L and the fitting stay 88L are integrally fastened so that a direction X in which the oil jet 81Lj for cooling each piston bored on the oil jet piping 81L exists and a direction Y in which the circular hole 88La at the base of the fitting stay 88L exists form a predetermined relative angle based upon a central axis of the oil jet piping 81L.

At the same time when the oil jet piping 81L to which the fitting stay 88L is integrally fastened via the cap member 86L as described above is inserted into the circular hole 85 of the left outermost journal wall 11Uw from its inner end and pierces the journal wall (see FIG. 9) and further pierces the circular hole 84 of the journal wall 11Uw on the way and is fitted into the circular hole of the central journal wall 11Uw via the collar 82 and the O-ring 83, the cap member 86L is press-fitted into the circular hole 85.

In press-fitting, when the circular hole 88La at the base of the fitting stay 88L is matched with the tapped hole 89L formed in a predetermined position of the left outermost journal wall 11Uw, turning the fitting stay 88L integrally with the oil jet piping 81L, the oil jet 81Lj for cooling each piston bored on the oil jet piping 81L can be easily set to a direction which is substantially upward right as shown in FIG. 10 and in which oil is efficiently jetted to each piston 30 reciprocated in the cylinder bore 12*c*.

The oil jet 81Lj for cooling each piston can be fixed in an optimum direction by making the clamping bolt 90L pierce the circular hole 88La at the base via the washer 91L, by screwing and tightening the clamping bolt into the tapped hole 89L after the above-mentioned setting.

As the other right fitting structure of the oil jet piping 81R is substantially similar to the oil jet piping 81L, the oil jet 81Rj for cooling each piston can be fixed in an optimum direction by a similar method.

However, the right fitting stay 88R is a little larger than the left fitting stay 88L and has a little longer distance between the circular hole at the end and the circular hole at the base.

Therefore, as the tapped hole formed in the predetermined position of the journal wall 11Uw and the circular hole at the base are not matched when the right oil jet piping and the left oil jet piping are mistaken and the clamping bolt cannot be screwed, it can be known that the right one and the left one are mistaken and wrong mounting can be prevented.

The left and right oil jet pipings 81L, 81R are fitted to pierce the five journal walls 11Uw of the upper crankcase 11U as described above effectively provide jet oil to each piston 30 in the cylinder bore 12*c* to which each oil jet 81Lj, 81Rj for cooling each piston corresponds for efficiently cooling the piston 30.

The oil jet member 87L is press-fitted to the left end of the left oil jet piping 81L and oil is jetted to the left from the oil jet 87Lj for cooling the generator of the oil jet member 87L.

The oil jet 87Lj for cooling the generator does not jet oil directly to the AC generator 47 but jets oil toward an annular space between a peripheral surface of the outer rotor 47*r* of the AC generator 47 and an inner surface of the generator cover 48 so as to cool the AC generator 47.

As shown in FIG. 10, when the oil jet 87Lj for cooling the generator is viewed in a direction of the crankshaft, the oil jet 87Lj for cooling the generator is inside the generator cover 48 and is located on the upside of the pulser coil 49 close to the front of the outer rotor 47*r* on the diagonal upside in the front in the vicinity of the outer periphery of the outer rotor 47*r* of the AC generator 47.

In the front view shown in FIG. 7, the oil jet 87Lj for cooling the generator is located on the right side (on the left side in FIG. 7) of the outer rotor 47*r* and the pulser coil 49 is respectively overlapped.

Therefore, as oil is jetted to space around the outer rotor 47*r* from the oil jet 87Lj for cooling the generator, the oil is diffused. However, the space in which the oil is diffused is the annular space between the peripheral surface of the outer rotor 47*r* of the AC generator 47 and the inner surface of the generator cover 48 and is substantially limited to space on the upside of the pulser coil 49 and on the diagonal upside in front of the outer rotor 47*r*.

The oil diffused space is a part of space provided to arrange the pulser coil 49.

As the outer rotor 47*r* of the AC generator 47 is turned counterclockwise as shown by an arrow in a left side view shown in FIG. 10, the pulser coil 49 is located next to an oil jetted area on the downstream side in a rotational direction of the oil jetted area from the oil jet 87Lj for cooling the generator and oil is diffused in a substantially limited small space without the diffusion in a large space of oil described above. Thus, the oil diffused space is filled with atomized oil.

As the outer rotor 47*r* is turned with the peripheral surface exposed to the oil diffused space filled with the oil, oil is uniformly diffused on the overall peripheral surface of the outer rotor 47*r* and the AC generator 47 can be efficiently cooled.

As the oil jet 87Lj for cooling the generator does not jet oil directly to the outer rotor 47*r* but jets and diffuses oil towards/in the space in the vicinity, reaction to the turning of the outer rotor 47*r* is never increased.

As a part of the space provided to arrange the pulser coil 49 is utilized for the oil diffused space where the oil jet 87Lj for cooling the generator jets and diffuses oil, the internal combustion engine can be prevented from being large-sized by separately providing space.

As described above, as the oil jet piping 81L for cooling each piston is utilized as means for supplying oil to the oil jet 87Lj for cooling the generator to cool the AC generator 47, an oil passage for cooling the AC generator 47 is not required to be newly formed. Thus, the structure is simplified, processing man-hours and the number of parts are reduced, and the cost can be reduced.

As the paths of oil supply are configured as described above, oil discharged from the discharge port 70*b* when the oil pump 70 is driven flows into the oil filter 76 from the second oil supply passage A2 through the first oil supply passage A1 (the oil supply pipe 75), impurity such as dust is removed there. Thereafter, the oil flows into the third oil supply passage A3, flows into the oil cooler 77 through the inflow port 78*a* and is cooled there. The oil then flows from the outflow port 78*b* into the fourth oil supply passage A4, reaches the main gallery A5, flows from the main gallery A5 to the crankshaft 10 and into the oil supply passages B1, B2 through the oil branch supply passage A6, and the oil is supplied to hydraulic equipment such as the cam chain tensioner 43 through each part to be lubricated such as the transmission 50 and the oil supply passages C1, C2, C3, C4.

In the meantime, oil divided into the first oil supply passage D1 from the outflow port 78*b* of the oil cooler housing 78H to which the oil cooler 77 is attached reaches the oil reservoir Da from the second oil supply passage D2 via a filter 80 on the joined faces of the upper crankcase 11U and the lower crankcase 11L, is distributed from the oil reservoir Da to the left and right oil jet pipings 81L, 81R, is jetted from the oil jets 81Lj, 81Rj for cooling each piston of the oil jet pipings 81L, 81R and the oil jet 87Lj for cooling the generator. Thus, each piston 30 is cooled by the oil jetted from the oil jets 81Lj, 81Rj for cooling each piston. In addition, the AC generator 47 is cooled by the oil jetted from the oil jet 87Lj for cooling the generator.

As the oil cooler housing 78H and an inlet of the oil jet pipings 81L, 81R are both located in the substantial center in a cylinder array direction in the crankcase, the first oil supply passage D1 and the second oil supply passage D2 as a communicating passage for cooling each piston connecting the outflow port 78*b* of the oil cooler housing 78H and the oil reservoir Da in which the inlet of the oil jet pipings 81L, 81R as oil passages for cooling each piston is located are designed so that the oil supply passages is possibly short. Therefore, the incoming radiational area on the way of the supply of oil is reduced, oil possibly kept at low temperature is taken into the oil jet pipings 81L, 81R from the inlet in the center in the cylinder array direction, and can be substantially uniformly jetted to each piston 30 from each oil jet 81Lj, 81Rj for cooling each piston.

As the oil reservoir Da is provided on the upstream side on which oil is distributed to the left and right oil jet pipings 81L, 81R, the pulsation of the oil discharge pressure of the oil pump 70 is attenuated, oil is distributed to the oil jet pipings 81L, 81R, is stably supplied to the oil jets 81Lj, 81Rj for cooling each piston and the oil jet 87Lj for cooling the generator, is stably jetted from the oil jets 81Lj, 81Rj for cooling each piston and the oil jet 87Lj for cooling the generator, and each piston 30 and the AC generator 47 can be more efficiently cooled.

In addition, as described above, as the tapped hole 26*f* is formed from the joined face of the cylinder block 12 to the cylinder head 13 to the oil reservoir Da, the stud bolt 25*f* that pierces the cylinder head 13 and the cylinder block 12 is screwed into the tapped hole 26*f* and the end projects into the oil reservoir Da. Thus, the concentration in a part of the stress that acts on the vicinity of the tapped hole of the upper crankcase 11U by screwing and tightening the stud bolt 25*f* can be reduced.

As the stress concentration reducing structure is configured utilizing the oil reservoir Da for stably supplying oil to the oil jets 81Lj, 81Rj, 87Lj, a dedicated structure is not required separately and the operation of this dedicated structure is not required.

As the oil reservoir Da utilizes the cavity 28 of the central journal wall 11Uw, oil is uniformly distributed to the left and right oil jet pipings 81L, 81R, is uniformly supplied to the four oil jets 81Lj, 81Rj for cooling each piston 30, and can be jetted from them. As the oil jets 81Lj, 81Rj for cooling each piston are formed on the left and right oil jet pipings 81L, 81R, a plurality of oil jets 81Lj, 81Rj for cooling each piston can be concentrated on the oil jet pipings 81L, 81R as a tube-like member as compared with the situation wherein an oil jet is attached to each journal wall of the crankcase. Therefore, the internal combustion engine is excellent in ease of assembly.

In this embodiment, the two oil jet pipings 81L, 81R extend sideways from the oil reservoir Da. However, only one oil jet piping extends and an inlet open to the oil reservoir may be also provided in a central location that pierces the oil reservoir.

In the water-cooled internal combustion engine E, a cooling system that the drive shaft 71 and the drive shaft 101 are coupled and cooling water is supplied by the water pump 100 driven in interlock with the oil pump 70 that is configured as a supply source for cooling water.

In the cooling system of this internal combustion engine E, referring to FIG. 1, the water pump 100 is attached to the rear of the left side wall of the lower crankcase 11L as described above, a radiator 105 is arranged in front of the internal combustion engine E, and a thermostat 110 is coupled to an outflow pipe 108 extending rearwardly from the downside of the intake port 33 of the cylinder at the right end of the cylinder head 13.

The other end of a radiator inflow hose 106, one end of which is connected to a connecting pipe 110*a*, projects on the right side of the thermostat 110 that is connected to an inflow port of the radiator 105 detouring forward on the right side of the cylinder block 12 as shown in FIGS. 2 and 3.

The connecting pipe 110*a* projects in a space between the cam chain tensioner 43 and the overhanging part 11Ua of the upper crankcase 11U as shown in FIG. 2, the radiator inflow hose 106 passes the space, and extends to the right.

The water pump 100 is configured by a pump body 100*a* in which a pump house for housing an impeller 102 that is integrally turned with the drive shaft 101 journals the drive shaft 101 and a pump cover 100*b* (see FIG. 6). The other end of a radiator outflow hose 107, one end of which is connected to a connecting pipe 103*a*, extends in front of a suction port of the pump cover 100*b* and is connected to an outflow port of the radiator 105 arranged along a lower part of the left side of the lower crankcase 11L.

A bypass hose 112, one end of which is connected to a connecting pipe 103*b*, extends on the upside of the same suction port of the pump cover 100*b* and extends upwardly along each rear of the left sides of the lower crankcase 11L and the upper crankcase 11U as shown in FIGS. 1 and 3. The bypass hose 112 is bent on the diagonal right side forward on a top face of the upper crankcase 11U, passes the left side of the starter motor 60 and extends to the right and diagonally upwardly between the starter motor 60 and the cylinder block 12 or the cylinder head 13 as shown in the plan view in FIG. 3. The other end is connected to a bypass outflow port on the upside of the thermostat 110.

Further, a pump discharge hose 113, one end of which is connected to a connecting pipe 103*c*, extends from a discharge port of the pump cover 100*b* of the water pump 100 and extends upwardly along each rear of the left sides of the lower crankcase 11L and the upper crankcase 11U. The pump discharge hose 113 is bent forward, and the other end is connected to an inflow connecting pipe 115*b* extending at the diagonal back of a joint member 115 projecting from the left side of the cylinder block 12.

The joint member 115 has an internal space 115*a* open to a joined face to the cylinder block 12 and is longer in height. A flange part at the edge of an opening is fastened to the cylinder block 12 by bolts 116 in three locations (see FIGS. 1 and 4).

As shown in FIG. 4, a lower inflow port 120 and an upper inflow port 121 are respectively vertically partitioned and are formed opposite to the opening of the internal space 115*a* of the joint member 115 on the left side wall of the cylinder block 12. The lower inflow port 120 communicates with a first water jacket 12*w* formed around the cylinder bore 12*c* of the cylinder block 12 with a communicating hole 122 bent upwardly that is arranged to a communicating hole 123 of the cylinder head 13 from the upper inflow port 121. The communicating hole 123 communicates with a second water jacket 13*w* of the cylinder head 13.

As shown in FIG. 1, a branch connecting pipe 115*c* is extends diagonally forward from the joint member 115 with an inflow hose 117 for the oil cooler one end of which being connected to the branch connecting pipe 115*c* and extending diagonally forward and downward. The other end is connected to a water inflow port of the oil cooler 77 projecting from the front of the lower crankcase 11L.

An outflow hose 118 extends from a water outflow port of the oil cooler 77 that is coupled to the radiator outflow hole 107 and returns cooling water via the oil cooler 77 to the water pump 100 utilizing a part of the radiator outflow hose 107.

The cooling system of this internal combustion engine E is configured as described above, cooling water discharged by the drive of the water pump 100 reaches the joint member 115 of the cylinder block 12 through the pump discharge hose 113 with the lower inflow port 120 and the upper inflow port 121 respectively on the left side wall of the cylinder block 12 branching from the joint member 115 of the cylinder block 12. Cooling water that flows into the lower inflow port 120 flows to the right in the first water jacket 12*w* of the cylinder block 12 and cools the cylinder block 12 with the cooling water that flows into the upper inflow port 121 flowing to the right in the second water jacket 13*w* of the cylinder head 13 through the communicating holes 122, 123 for cooling the cylinder head 13.

A gasket (not shown) is held between the joined faces of the cylinder block 12 and the cylinder head 13 for partitioning the first water jacket 12*w* of the cylinder block 12 and the second water jacket 13*w* of the cylinder head 13. However, a communicating hole is bored in a part of the right end wherein cooling water that cools the cylinder block 12 flows from the first water jacket 12*w* into the second water jacket 13*w*, cooling water that flows independently in the first water jacket 12*w* and in the second water jacket 13*w* meets and the cooling water that flows out of the outflow pipe 108 extends rearwardly at the right end of the rear of the cylinder head 13, and reaches the thermostat 110.

The thermostat 110 controls the circulation and the cutoff of cooling water to the radiator 105 according to the warming up of the internal combustion engine E.

In warming up, warming up is accelerated by making cooling water that passes the cylinder block 12 and the cylinder head 13 flow into the bypass hose 112 without passing the radiator 105 and returning the water to the water pump 100. In a normal operation, after the warming up, the cooling water flows into the radiator 105 by switching to the flow into the radiator inflow hose 106, the temperature of the cooling water is lowered by circulating the cooling water in the radiator, and the cooling of the cylinder block 12 and the cylinder head 13 is accelerated.

In the meantime, cooling water discharged into the pump discharge hose 113 from the water pump 100 is divided into the lower inflow port 120 and the upper inflow port 121 of the cylinder block 12 via the joint member 115. The cooling water is circulated so as to cool oil so that the cooling water is also divided into the inflow hose 117 in the internal space 115*a* of the joint member 115, reaches the oil cooler 77 and returns to the water pump 100 via a part of the radiator outflow hose 107 through the outflow hose 118 from the oil cooler 77.

As described above, oil cooled by the oil cooler 77 is divided into the first oil supply passage D1 from the outflow port 78*b* of the oil cooler housing 78H, is distributed to the left and right oil jet pipings 81L, 81R through the second oil supply passage D2 and the oil reservoir Da, is jetted to each piston 30 from the oil jets 81Lj, 81Rj for cooling each piston, cools each piston 30, is jetted from the oil jet 87Lj for cooling the generator, and cools the AC generator 47.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An accessories arrangement structure for an internal combustion engine for a motorcycle comprising:

an oil cooler;

an oil filter operatively connected to the oil cooler; and a balancer being mounted adjacent to the oil filter, said oil cooler, said oil filter and said balancer being in a lower part and in a front of a crankcase that journals a crankshaft directed in a vehicular width direction;

wherein the oil cooler and the oil filter are respectively attached to the front in a vehicular traveling direction of the crankcase with the oil cooler and the oil filter projecting therefrom; and the balancer, the oil cooler and the oil filter are adjacent and are arranged abreast in parallel with the crankshaft in a front view of the vehicle wherein in a vehicular side view based upon the crankshaft, an oil cooler housing for housing the oil cooler and an oil filter housing for housing the oil filter are arranged wherein the housings are overlapped with the balancer, and further comprising a balancer lubricating oil communicating passage for communicating the oil cooler housing with a balancer chamber for housing the balancer, wherein the internal combustion engine is an in-line multi-cylinder internal combustion engine in which a plurality of cylinders are arranged in series, and wherein a straight line L2 tying each center of the oil filter and the oil cooler is overlapped with a balancer shaft of the balancer and is parallel to a central axis L1 of the crankshaft.

2. The accessories arrangement structure of the internal combustion engine for the motorcycle according to claim 1, wherein a piston cooling oil passage for jetting oil to the piston from an oil jet formed in a passage is arranged on an axis parallel to the crankshaft;

the oil cooler is attached to an oil cooler housing formed in the vicinity of a center in a cylinder array direction of the crankcase; and a piston cooling oil communicating passage for communicating an inlet in the center in the cylinder array direction of the piston cooling oil passage with the oil cooler housing.

3. The accessories arrangement structure of the internal combustion engine for the motorcycle according to claim 1, wherein the balancer includes a shaft that is parallel to a central axis of the crankshaft and the oil filter, the oil cooler and the balancer form a predetermined weight that is concentrated in one area to increase maneuverability of the motorcycle.

4. The accessories arrangement structure of the internal combustion engine for the motorcycle according to claim 1, further comprising a secondary balancer operatively mounted within the balancer chamber of the balancer, said secondary balancer being positioned downwardly and in a diagonal front section of the crankshaft.

5. The accessories arrangement structure of the internal combustion engine for the motorcycle according to claim 4, wherein the secondary balancer includes a balance weight journalled by a balancer shaft with a bearing and a balancer driven gear being mounted on an outer periphery of a boss of the balance weight.

6. An accessories arrangement structure adapted to be used with an internal combustion engine comprising:

an oil cooler;

an oil filter operatively connected to the oil cooler;

a balancer being mounted adjacent to the oil filter and said oil cooler; and a front of a crankcase being formed to a front in a vehicle traveling direction, said oil filter, said oil cooler and said balancer being positioned in the front of the crankcase wherein a crankshaft is operatively positioned within said crankcase and said crankshaft is directed in a vehicular width direction, said oil cooler, the oil filter and the balancer projecting from said front of said crankcase; and the balancer, the oil cooler and the oil filter are adjacent to each other and are arranged abreast in parallel with the crankshaft in a front view of the vehicle wherein in a vehicular side view based upon the crankshaft, an oil cooler housing for housing the oil cooler and an oil filter housing for housing the oil filter are arranged wherein the housings are overlapped with the balancer, and further comprising a balancer lubricating oil communicating passage for communicating the oil cooler housing with a balancer chamber for housing the balancer, wherein the internal combustion engine is an in-line multi-cylinder internal combustion engine in which a plurality of cylinders are arranged in series, and wherein a straight line L2 tying each center of the oil filter and the oil cooler is overlapped with a balancer shaft of the balancer and is parallel to a central axis L1 of the crankshaft.

7. The accessories arrangement structure adapted to be used with the internal combustion engine according to claim 6, wherein a piston cooling oil passage for jetting oil to the piston from an oil jet formed in a passage is arranged on an axis parallel to the crankshaft;

the oil cooler is attached to an oil cooler housing formed in the vicinity of a center in a cylinder array direction of the crankcase; and a piston cooling oil communicating passage for communicating an inlet in the center in the cylinder array direction of the piston cooling oil passage with the oil cooler housing.

8. The accessories arrangement structure adapted to be used with the internal combustion engine according to claim 6, wherein the balancer includes a shaft that is parallel to a central axis of the crankshaft and the oil filter, the oil cooler and the balancer form a predetermined weight that is concentrated in one area to increase maneuverability of the vehicle.

9. The accessories arrangement structure adapted to be used with the internal combustion engine according to claim 6, further comprising a secondary balancer operatively mounted within the balancer chamber of the balancer, said secondary balancer being positioned downwardly and in a diagonal front section of the crankshaft.

10. The accessories arrangement structure adapted to be used with the internal combustion engine according to claim 9, wherein the secondary balancer includes a balance weight journalled by a balancer shaft with a bearing and a balancer driven gear being mounted on an outer periphery of a boss of the balance weight.

11. The accessories arrangement structure adapted to be used with the internal combustion engine according to claim 1, and when viewed in the front view of the motorcycle, the balancer, the oil cooler and the oil filter are arranged in non-overlapping positions.

12. The accessories arrangement structure adapted to be used with the internal combustion engine according to claim 1, wherein in a vehicular side view, an oil cooler housing for housing the oil cooler can be seen to extend above an upper side of the balancer.

13. The accessories arrangement structure adapted to be used with the internal combustion engine according to claim 1, wherein a forward part of the oil filter extends further toward a front of the motorcycle than any portion of the balancer and the oil cooler.

14. The accessories arrangement structure adapted to be used with the internal combustion engine according to claim 1, wherein the oil filter and the oil cooler have axes that extend in a direction parallel to a lower surface of the crankcase.

15. The accessories arrangement structure adapted to be used with the internal combustion engine according to claim 1, wherein the balancer lubricating oil communicating passage communicating the oil cooler housing with the balancer chamber extends in a direction parallel to an axis of the crankshaft.

16. The accessories arrangement structure adapted to be used with the internal combustion engine according to claim 15, since the oil cooler housing and the balancer chamber are adjacent to each other in the vehicular width direction, a length of the balancer lubricating oil communicating passage which extends in the direction parallel to the axis of the crankshaft can be reduced, and immediately after lubricating the oil cooler, oil is directly supplied to the balancer, thereby minimizing a pump loss.

17. The accessories arrangement structure adapted to be used with the internal combustion engine according to claim 6, wherein the balancer lubricating oil communicating passage communicating the oil cooler housing with the balancer chamber extends in a direction parallel to an axis of the crankshaft.

18. The accessories arrangement structure adapted to be used with the internal combustion engine according to claim 17, since the oil cooler housing and the balancer chamber are adjacent to each other in the vehicular width direction, a length of the balancer lubricating oil communicating passage which extends in the direction parallel to the axis of the crankshaft can be reduced, and immediately after lubricating the oil cooler, oil is directly supplied to the balancer, thereby minimizing a pump loss.

* * * * *